US005919037A

United States Patent [19]

Brillhart, III et al.

[11] Patent Number: 5,919,037

[45] Date of Patent: Jul. 6, 1999

[54] FIRE STARTING TOOL

[75] Inventors: Lee W. Brillhart, III, Seattle; Rick W. Stewart, Mukilteo, both of Wash.

[73] Assignee: Survival, Inc., Seattle, Wash.

[21] Appl. No.: 08/895,916

[22] Filed: Jul. 17, 1997

[51] Int. Cl.[6] ..... F23Q 1/02

[52] U.S. Cl. ..... 431/273; 431/133; 431/127; 431/124; 431/2; 126/25 B

[58] Field of Search ..... 431/133, 287, 431/269, 273, 275, 274, 276, 267, 127, 253, 135, 137, 2, 124; 126/25 B

[56] References Cited

U.S. PATENT DOCUMENTS

| | | | |
|---|---|---|---|
| 153,628 | 7/1874 | Straszer | 431/269 |
| 995,463 | 6/1911 | Hubert . | |
| 1,027,900 | 5/1912 | Ramsdell | 431/277 |
| 1,041,795 | 10/1912 | Hubert | 431/275 |
| 1,066,405 | 7/1913 | Goldstein . | |
| 1,207,631 | 12/1916 | RoKeach . | |
| 1,898,991 | 2/1933 | Cox . | |
| 2,483,437 | 10/1949 | Rizer . | |
| 3,402,029 | 9/1968 | Sampson, Jr., III et al. . | |
| 3,471,246 | 10/1969 | Piffath et al. . | |
| 4,188,192 | 2/1980 | Levenson et al. . | |
| 4,698,068 | 10/1987 | Jensen . | |
| 4,770,669 | 9/1988 | Allen et al. . | |
| 5,279,628 | 1/1994 | Hutchens et al. . | |

FOREIGN PATENT DOCUMENTS

| | | | |
|---|---|---|---|
| 177951 | 9/1905 | Germany | 431/274 |
| 41110 | 10/1909 | Germany | 431/275 |

*Primary Examiner*—Carl D. Price
*Attorney, Agent, or Firm*—Richardson & Folise

[57] ABSTRACT

A hand operated fire starting tool for use as a survival aid and in general outdoor activities such as camping. The tool includes a case, a pyrophoric element mounted to the case for reciprocal and rotational movement between a stored position and an operating position. It also includes means such as a spring for biasing the element toward the operating position and a striker which may be engaged with the element. The tool also includes a cap which is both pivotally and slidably mounted to the case for releasingly securing the element in its stored position.

25 Claims, 3 Drawing Sheets

FIRE STARTING TOOL

BACKGROUND OF THE INVENTION

This invention relates generally to fire starting devices and more particularly to a hand operated fire starting tool for use as a survival aid and in general outdoor activities such as camping.

Presently there are a wide variety of fire starting devices available for use in an outdoor environment, probably the most common of which is the ordinary match. Among the advantages of a match are that it is light in weight, compact, and combines both an ignition source and fuel in a single unit. Even so, matches have a number of deficiencies which significantly limit their usefulness in an outdoor environment. If allowed to become damp or wet then they either fail to ignite or to continue burning after ignition. Also, they are difficult or impossible to ignite if the striking surface is wet. Further, because a match burns at a relatively low temperature the heat it produces may be insufficient to ignite damp or wet kindling. Finally, they are very susceptible to being blown out by wind gusts, so under windy conditions they must be carefully sheltered.

Another well known type of fire starting device is the common lighter which typically has a reservoir of liquid fuel, means for vaporizing the fuel and a spark generating apparatus. Typical fuels used in such lighters include naphtha, alcohol and butane and sparks are generated by forcing a flint element into contact with a moving steel wheel. If the fuel exists in a gaseous state at normal temperature and pressure then a flame is generated by releasing ignitable vapors near the flint through a manually operable valve and then creating a spark to ignite them. Fuels normally in a liquid state such as naphtha or alcohol are ignited by drawing them from the reservoir to the vicinity of the spark generator with a wick and then actuating the generator to ignite the emitted vapors. Lighters of this type are superior to matches in that they will burn much longer and are more reliable under moist conditions. However they are limited by the available fuel supply and are easily extinguished by wind gusts.

In recent years a more sophisticated class of fire starters have appeared on the market. These devices typically include a pyrophoric element, a housing in which the element is mounted and a striker which is removably attached to the housing. The devices may also include a supply of fuel such as tinder. In order to start a fire with such devices the kindling is first appropriately positioned near a larger fuel source such as dry wood or paper. Next, the striker is disengaged from the housing and struck against the pyrophoric element in such a way that sparks generated by the impact are directed into the tinder, setting it ablaze. In one variation of such devices the pyrophoric element is made of an ignitable magnesium alloy. In using such a device a small pile of shavings of the alloy is first collected and placed next to the fuel source. Then, sparks generated with the striker and the pyrophoric element are directed into the pile of shavings which ignite with the intensely white flame characteristic of burning magnesium. The burning shavings then ignite the larger fuel source. The second variation of such devices also employs a magnesium alloy element as a source of magnesium shavings but the element is not pyrophoric in nature. A separate pyrophoric element mounted to the magnesium alloy element and a separate striker is used to create sparks. One advantage of all magnesium alloy fire starting devices is that they produce a very intense and hot flame which theoretically facilitates fire starting. In practice however, the alloy shavings are consumed very quickly so fire starting with such devices can be difficult under wet or cold conditions when longer exposure to flame may be necessary to ignite fuel. Also such devices tend to be more hazardous to use because of the very high temperatures at which magnesium burns. Finally, the number of instances in which such devices can be used is inherently limited by the amount of magnesium alloy available to produce shavings.

Therefore it can be seen that while the various types of fire starting devices found in the prior art have certain advantages they also have significant limitations. As stated, many of them are difficult to use under rainy, cold, or windy conditions. Also those which rely upon specialized fuels are necessarily limited by the amount of such fuels available. Finally, many of the devices require two hands to operate, making then inconvenient for use by a lone user under certain conditions.

Accordingly it is an object of this invention to provide for an improved fire starting tool which will function reliably in an outdoor environment even under rainy, cold, or windy conditions.

It is another object of this invention to provide for an improved fire starting tool which can be operated with a single hand, thus facilitating use by an injured person and leaving the operator a free hand to perform other operations such as holding a flashlight.

It is yet another object of this invention to provide for such a fire starting tool which is not dependant upon specialized fuels to produce ignition but which utilizes fuels generally available in an outdoor environment such as tinder, twigs, and wood chips.

Finally, another object of this invention is to provide for such a fire starting tool which is compact, relatively easy to operate and in which use of the pyrophoric element is maximized.

SUMMARY OF THE INVENTION

This invention can be broadly summarized as providing for an improved fire tool device for use in an outdoor environment. The preferred embodiment includes a case and a pyrophoric element mounted to the case so as to permit reciprocating movement of the element between a stored position and an operating position. It also includes means, preferably a spring, for biasing the element toward the operating position and a striker which may be engaged with the element.

In accordance with a more detailed aspect of the invention the device also includes a cap for releasingly securing the element in a stored position where it would normally be maintained when the tool is not in use. According to a yet more detailed aspect of the invention the cap is both pivotally and slidably mounted to the case and is moveable among three positions referred to as a closed position, an extended position, and an open position.

DETAILED DESCRIPTION OF THE PREFERRED EMBODIMENTS

The novel features believed to be characteristic of this invention are set forth in the appended claims. The invention itself, however, may be best understood in its various objects and advantages best appreciated by reference to the detailed description below in connection with the accompanying drawings.

Figure 5:
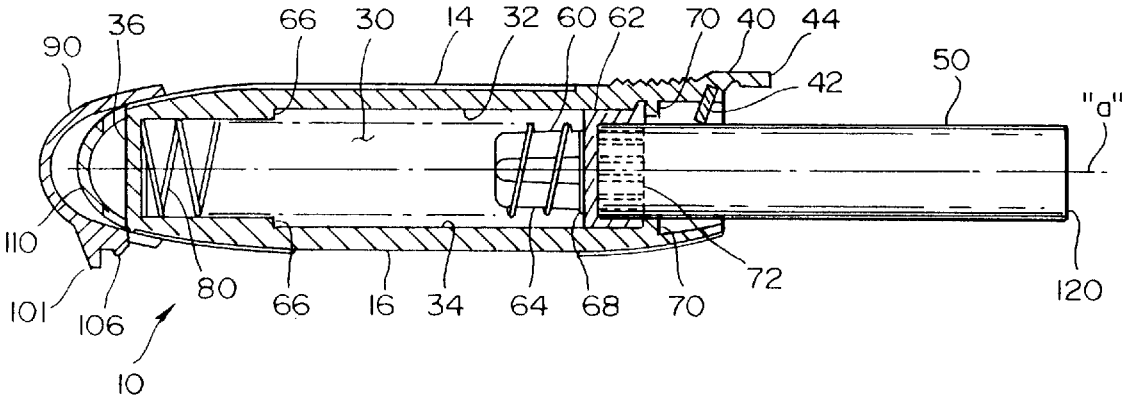
FIG. 5 is a sectional view of the device as configured in FIG. 3.
Figure 6:
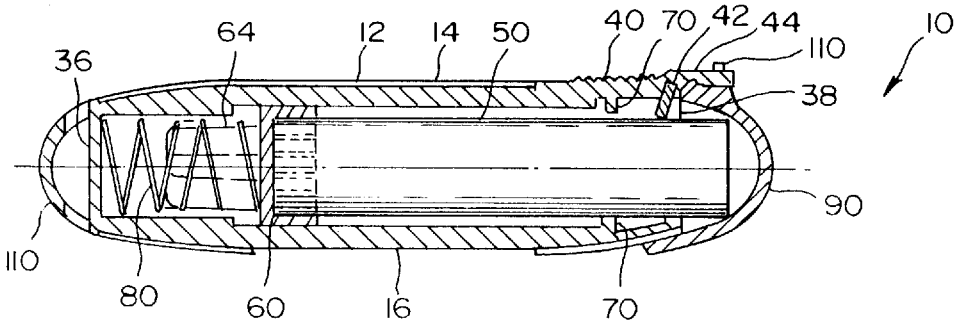
FIG. 6 is a sectional view of the device as configured in FIG. 1.

FIGS. 1 through 8 illustrate a fire starting tool constructed in accordance with the teachings of the present invention and generally designated by the number 10. Referring to FIGS. 1 through 6 it can be seen that the tool includes an elongated case 12 formed of an upper half 14 and a lower half 16 joined at interface 20. Referring to FIGS. 5 and 6 it can be seen that the case includes elongated interior chamber 30 which is defined by interior walls 32 and 34 of the upper and lower halves respectively together with bulkhead 36. A circular opening 38 is formed in the right hand end of the chamber. Flexible cantilevered arm 40 is formed as a part of upper half 14 and carbide striker 42 is attached to the arm as shown. The arm is positioned so that, unless depressed, the striker is slightly spaced from the flint bar. This design feature is intended to minimize the possibility of inadvertent striking when the cap is disengaged from its closed position, as discussed below.

The fire starting tool also includes cylindrical flint bar 50 which is mounted for both reciprocal and rotational movement within chamber 30. Referring to FIG. 5, the direction of such reciprocal movement is parallel to central axis "a" of the bar, and rotational movement is about such axis. Mounted to the inner end of the flint bar is flint stop 60 which has a cylindrical base 62 and an upper portion 64. Base 62 is sized in diameter so as to slidably engage interior walls 32 and 34 of the case. Referring again to FIG. 5 it can be seen that movement of the flint bar into the case is limited by step 66 which will contact upper surface 68 of flint stop 60 as the flint bar moves to the left. Movement of the flint bar out of the case is limited by annular protrusion 70 which contacts surface 72 of the flint stop as the flint bar moves to the right. The flint bar is biased toward the position shown in FIG. 5, referred to as its operating position, by spring 80 which is disposed within chamber 30 and extends between bulkhead 36 of the case and surface 68 of the flint stop. Periodic rotation of the flint bar provides exposure of most of its cylindrical surface to the striker, thereby maximizing its useful life.

Figure 1:
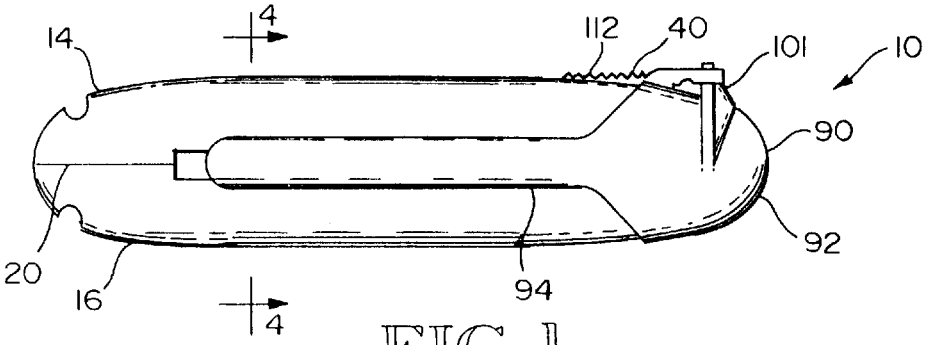
FIG. 1 is a side view of a fire starting tool in accordance with the teachings of the present invention.
Figure 2:
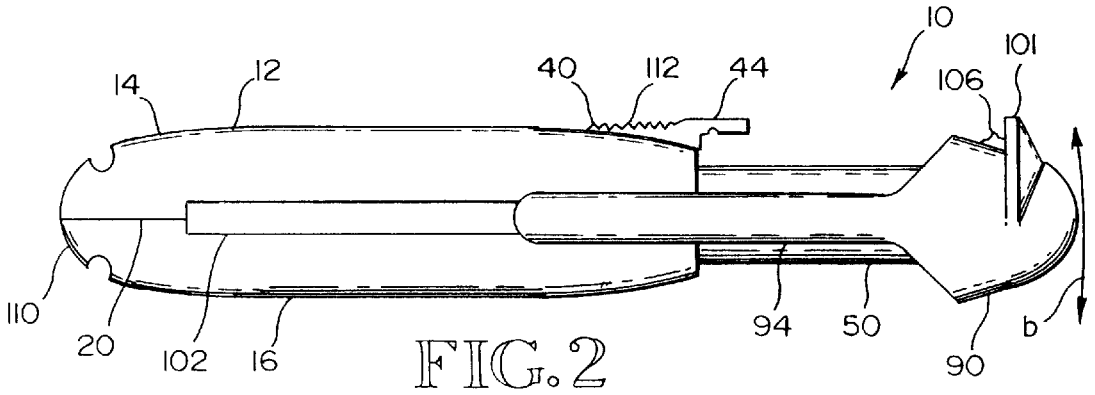
FIG. 2 is a side view of the device showing the cap in the extended position.
Figure 7:
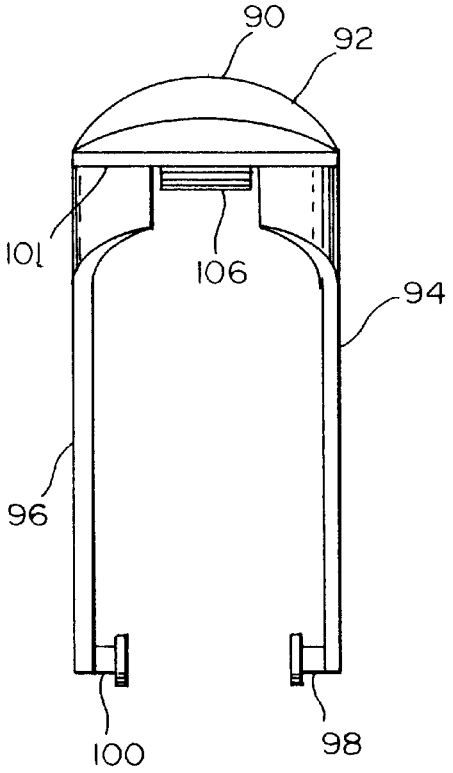
FIGS. 7 and 8 are top and right side views, respectively, of the cap.
Figure 8:
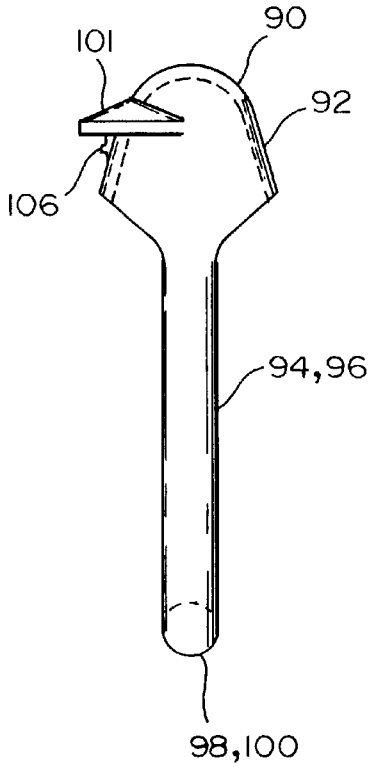

The fire starting tool also includes cap 90 which is illustrated separately in FIGS. 7 and 8. The cap includes hood 92, parallel arms 94 and 96 which extend from the hood, and pins 98 and 100 which are formed in the ends of arms 94 and 96 respectively. Also extending from the hood is lip 101. Referring again to FIGS. 1 through 4 it can be seen that the cap is slidably and pivotally mounted to case 12 by pins 98 and 100 which engage T-shaped slots 102 and 104 respectively formed in the sides of case 12. Such mounting permits the cap to be moved among three principle positions with respect to the case during operation of the tool which will be discussed in greater detail below. The first of such positions, referred to as the closed position, is shown in FIGS. 1 and 5. In those figures, flint bar 50 is held in its stored position by the cap which is releasably secured by a latching means including pawl 44 of the case and tooth 106 of the cap. FIG. 2 illustrates the cap in its extended position and the flint bar in its operating position. In that position hood 92 of the cap is clear of the flint bar and may be pivoted either upward or downward as indicated by double arrow "b" in that view. This position is merely a transitional one through which the cap is passed as it is moved between its closed and open positions. The cap is shown in its operating position in FIGS. 3 and 5 where it is retained by the frictional engagement of hood 92 with curved end 110 of the case. An advantage of this design is that it prevents loss of the cap during use.

Figure 3:
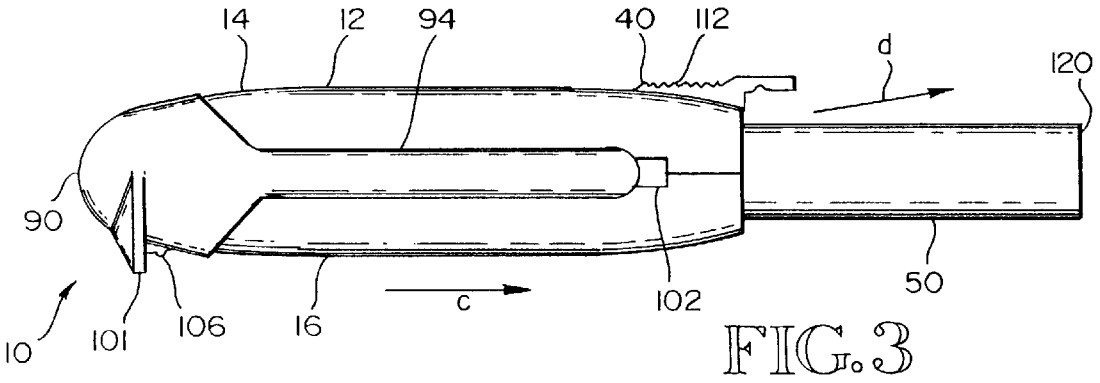
FIG. 3 is a side view of the device showing the cap in the open position.
Figure 4:
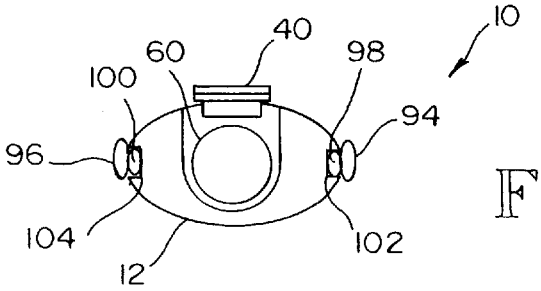
FIG. 4 is a sectional view taken at 4—4 of FIG. 1.

In order to start a fire with the tool the user begins by placing a pile of dry kindling or other easily ignitable fuel underneath or adjacent to a larger but also easily ignitable fuel source such as dry twigs or larger pieces of kindling. Next, the tool is readied for use by grasping the case in one hand, gently using the thumb to pull arm 40 upward sufficiently to disengage pawl 44 from tooth 106, and then pulling the cap to the right as shown in FIG. 1. After the latch is disengaged the cap is moved into the extended position as shown in FIG. 2 and then rotated into the open position as shown in FIG. 3. Next, the user presses downward on finger pad 112 on the top of arm 40, forcing striker 42 into engagement with flint bar 50. Then, outer end 120 of the flint bar is positioned against a solid object proximate the tinder and the case is repeatably thrust to the right as shown by arrow "c" in FIG. 3 causing a shower of sparks to be emitted from the point of contact of striker 42 with the flint bar and directed generally in the direction indicated by arrow "d" in FIG. 3. By appropriately positioning the tool the sparks will be directed into the tinder and will shortly set it ablaze. After the fire has been started the hood is disengaged from its open position, translated to the right and pivoted about pins 98 and 100 into its extended position as shown in FIG. 2. then the cap is translated to the left, forcing the flint bar back into chamber 30 until tooth 106 engages pawl 44, latching the cap in its closed position as shown in FIG. 1.

Thus it can be seen that the present invention provides for an improved fire starting tool which incorporates many novel features and offers significant advantages over the prior art. Although only one embodiment of this invention has been illustrated and described it is to be understood that obvious modifications can be made of it without departing from the true scope and spirit of the invention.

I claim:

1. A fire starting device comprising:

a case;

a pyrophoric element slidably mounted to the case for reciprocal movement between a stored position and an operating position;

means for biasing the element toward the operating position; and, a striker engageable with the element; and a cap mountable on the case for releasably securing the element in the stored position.

2. The fire starting device of claim 1 wherein the case includes an elongated chamber and wherein the element is mounted within the chamber.

3. The fire starting device of claim 2 wherein the chamber includes an opening and wherein the element extends through the opening when located in the operating position.

4. The fire starting device of claim 1 wherein the element includes a flint bar.

5. The fire starting device of claim 1 wherein the biasing means is a spring.

6. The fire starting device of claim 1 further including means for limiting the movement of the element from the stored position toward the operating position.

7. The fire starting device of claim 6 wherein the means for limiting is a stop mounted to the element.

8. The fire starting device of claim 7 wherein the means for limiting further includes a protrusion formed in the case and engageable with the stop.

9. The fire starting device of claim 1 wherein the striker is connected to the case.

10. The fire starting device of claim 1 wherein the striker is mounted to the case.

11. The fire starting device of claim 1 wherein the element is also rotatably mounted to the case.

12. The fire starting device of claim 1 wherein the cap is slidably mounted to the case.

13. The fire starting device of claim 1 wherein the cap is movable between a closed position and an open position.

14. The fire starting device of claim 1 wherein the cap is movable among a closed position, an extended position and an open position.

15. The fire starting device of claim 1 further including latching means for releasably securing the cap in the closed position.

16. The fire starting device of claim 15 wherein the latching means includes a pawl and a cooperating tooth.

17. The fire starting device of claim 16 wherein the pawl is attached to the case and the cap includes the tooth.

18. The fire starting device of claim 16 wherein the pawl is attached to the case and the striker is mounted to the pawl.

19. The fire starting device of claim 1 wherein the element is also rotatably mounted to the case.

20. A fire starting device comprising:

a case including an elongated chamber;

a pyrophoric element mounted in the chamber for reciprocating movement between a stored position and an operating position; and, a spring disposed within the case for biasing the element toward the operating position;

a stop for limiting movement of the element from the stored position toward the operating position;

a striker engageable with the element and mounted to the case; and, a cap pivotally and slidably mounted to the case for securing the element in the stored position.

21. A fire starting device comprising:

a case;

a pyrophoric element mounted to the case for reciprocal movement between a stored position and an operating position;

means for biasing the element toward the operating position;

a striker engageable with the element; and, a cap pivotably mounted on the case for releasably securing the element in the stored position.

22. A fire starting device comprising:

a case;

a pyrophoric element mounted to the case for reciprocal movement between a stored position and an operating position;

means for biasing the element toward the operating position;

a striker engageable with the element; and, a cap pivotably and slidably mounted on the case for releasably securing the element in the stored position.

23. A method for starting a fire using a fire starting device, the device including a case, a pyrophoric element mounted to the case for reciprocal movement between a stored position and an operating position, means for biasing the element toward the operating position and a striker engageable with the element, the method comprising the steps of:

positioning the element in the operating position;

placing the element against a solid object proximate a final source;

engaging the element with the striker; and, reciprocating the case with respect to the element such that sparks thereby generated are directed toward the fuel source.

24. The fire starting method of claim 23 wherein the fire starting device includes a cap mountable on the case for releasably securing the element in the stored position.

25. A fire starting device comprising:

a case;

a pyrophoric element slidably mounted to the case for reciprocal movement between a stored position and an operating position;

means for biasing the element toward the operating position;

a striker engageable with the element; and, a cap mountable on the case and releasably engageable with the element for securing the element in the stored position.

* * * * *